US010357677B2

(12) United States Patent
Austin

(10) Patent No.: US 10,357,677 B2
(45) Date of Patent: Jul. 23, 2019

(54) TOTAL BODY BOARD RACK

(71) Applicant: Charles Austin, San Marcos, TX (US)

(72) Inventor: Charles Austin, San Marcos, TX (US)

( * ) Notice: Subject to any disclaimer, the term of this patent is extended or adjusted under 35 U.S.C. 154(b) by 0 days.

(21) Appl. No.: 14/629,507

(22) Filed: Feb. 24, 2015

(65) Prior Publication Data

US 2016/0243394 A1 Aug. 25, 2016

(51) Int. Cl.

| | |
|---|---|
| ***A63B 21/04*** | (2006.01) |
| ***A63B 21/055*** | (2006.01) |
| ***A63B 21/16*** | (2006.01) |
| ***A63B 17/04*** | (2006.01) |
| ***A63B 21/00*** | (2006.01) |

(52) U.S. Cl.

CPC ..... *A63B 21/0442* (2013.01); *A63B 21/0552* (2013.01); *A63B 21/0557* (2013.01); *A63B 21/16* (2013.01); *A63B 17/04* (2013.01); *A63B 21/00065* (2013.01)

(58) Field of Classification Search

CPC ..... A63B 21/0442; A63B 21/04; A63B 21/02; A63B 21/05–0557; A63B 69/0048; A63B 9/00; A63B 2009/006

USPC ..... 482/23, 35–37, 92, 121–126, 129, 130, 482/142, 148

See application file for complete search history.

(56) References Cited

U.S. PATENT DOCUMENTS 3,618,942 A * 11/1971 Bates ..... A63B 21/04 473/229
3,735,979 A * 5/1973 Levenberg ..... A63B 9/00 482/143
4,241,914 A * 12/1980 Bushnell ..... A63B 1/00 482/130
4,503,845 A * 3/1985 Licciardi ..... A61H 1/0218 482/144
4,772,011 A * 9/1988 Guridi ..... A63B 1/005 482/37
4,848,741 A * 7/1989 Hermanson ..... A63B 21/0552 482/121
4,982,958 A * 1/1991 Ullman ..... A63B 21/04 482/123
5,100,130 A * 3/1992 Shoebrooks ..... A63B 21/4039 482/121
5,125,877 A * 6/1992 Brewer ..... A63B 69/0048 482/37
5,125,883 A * 6/1992 Shoebrooks ..... A63B 21/4039 482/121
5,156,580 A * 10/1992 Holland ..... A63B 1/00 482/38
5,919,117 A * 7/1999 Thompson ..... A63B 22/02 198/850
6,267,711 B1 * 7/2001 Hinds ..... A63B 1/00 482/121
6,514,178 B2 * 2/2003 Vettori ..... A63B 69/0048 482/35
6,551,215 B1 * 4/2003 Gordon ..... A63B 69/0048 472/134

(Continued)

*Primary Examiner* — Garrett K Atkinson

(74) *Attorney, Agent, or Firm* — Gunn, Lee & Cave, P.C.

(57) ABSTRACT

Disclosed is a new vertical body board fitness device. The device comprises a vertical body board comprising a plurality of pad eyes for running resistance bands therethrough and a stand to which the body board is secured. In one embodiment, the device comprises a vertical rectangular frame in lieu of the body board.

6 Claims, 9 Drawing Sheets

(56) References Cited

U.S. PATENT DOCUMENTS 6,626,801 B2 * 9/2003 Marques ..... A63B 17/00 482/23
6,860,836 B1 * 3/2005 Wu ..... A63B 22/001 198/850
6,872,175 B2 * 3/2005 Lin ..... A63B 21/0004 482/121
6,908,418 B2 * 6/2005 Saure ..... A63B 21/0552 482/121
7,094,183 B2 * 8/2006 Hsieh ..... A63B 22/18 482/123
7,229,392 B2 * 6/2007 Turnbull ..... A63B 21/04 482/129
7,731,632 B2 * 6/2010 Wu ..... A63B 69/0048 482/37
7,931,575 B2 * 4/2011 Rochford ..... A63B 21/04 482/148
8,057,370 B2 * 11/2011 Dunn ..... A63B 21/0552 482/121
8,721,507 B2 * 5/2014 Blancher ..... A63B 21/4033 482/121
8,821,359 B1 * 9/2014 Kassel ..... A63B 21/0442 482/121
8,858,402 B2 * 10/2014 Bruschke ..... A63B 23/03541 482/123
8,905,905 B2 * 12/2014 Mangalindan ..... A63B 23/1236 482/141
9,050,493 B2 * 6/2015 Perez ..... A63B 21/0557
9,132,330 B2 * 9/2015 Brendle ..... A63B 23/03541
9,149,677 B2 * 10/2015 Rountree ..... A63B 21/0442
2003/0186792 A1 * 10/2003 Keeler ..... A63B 21/0004 482/129
2004/0087420 A1 * 5/2004 Montesquieux ... A63B 21/0552 482/129
2010/0016126 A1 * 1/2010 Wu ..... A63B 69/0048 482/37
2012/0046145 A1 * 2/2012 Barriuso Oses ... A63B 69/0048 482/35
2014/0106938 A1 * 4/2014 Sudeith ..... A63B 69/0048 482/37
2014/0287894 A1 * 9/2014 Austin ..... A63B 21/0552 482/142
2015/0099613 A1 * 4/2015 Munoz Saez ..... A63B 21/16 482/139
2015/0343288 A1 * 12/2015 Taggart ..... A63B 69/0048 482/37

* cited by examiner

TOTAL BODY BOARD RACK

BACKGROUND

Field of the Invention

The present invention relates to body boards in the context of fitness and more particularly, to a vertical body board fitness device.

A body board device (or simply, a body board) is modern fitness equipment that is increasingly being used as an alternative to conventional gymnasiums. A body board device is very simple in its build comprising a stiff, generally rectangular planar member (i.e., a body board) and a plurality of means such as, hooks, pad eyes, eyelets, or the like, disposed thereon through which, resistance or fitness bands are run. These resistance bands, as the term suggests, offer varying degrees of resistance as per the necessity of the users. In order to use the body board device, the body board is simply to be laid on the ground or floor flat, and the resistance bands are attached thereto whereafter, with the user being on the body board, the resistance bands are "worked", "pulled" or "stretched" the with hands, feet, chest, etc., in various directions in various postures. Body board exercises are arguably said to achieve the same or even better fitness levels as compared to those achieved with traditional gym equipment. Better results are attributed to the flexibility offered by the body board device in terms of the myriad possibilities of postures and the ways of working with the resistance bands, which are not simply possible with traditional gym equipment.

However, on the flipside, the body boards so far known in the art are designed to be laid on the floor and the user is necessitated to be on it to work it. Therefore, body boards known in the art cater to one individual at a time. Secondly, as the body boards are horizontal, the exercises that involve stretching or pulling parallel to bodyline of the user are not possible.

In the light of what is discussed, there is a need in the art for a solution for body boards that satisfy the aforementioned needs.

SUMMARY

The present invention comprises a body board fitness device comprising a vertical rectangular body board attached to a stand for placement on the ground. The body board comprises planar front and rear surfaces from which a plurality of pad eyes extend for running resistance cables therethrough. While the vertical body board takes care of the bodyline exercises, the aspect of the pad eyes extending from either side of the body board makes it possible for two users to utilize the body board device at the same time.

Other objects and advantages of the embodiments herein will become readily apparent from the following detailed description taken in conjunction with the accompanying drawings.

FIGURES—REFERENCE NUMERALS

10—Body Board Fitness Device
12—Body Board
14—Stand
16—Frame
18—Sheet
20—Pad Eye
22—Side Board Rod
24—Horizontal Board Rod
24UT—Top Utility Board Rod
24UM—Mid Utility Board Rod
24UB—Bottom Utility Board Rod
24S—Support Board Rod
26—Leg
28—Top Stand Rod
30—Bottom Stand Rod
32—Side Stand Rod

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
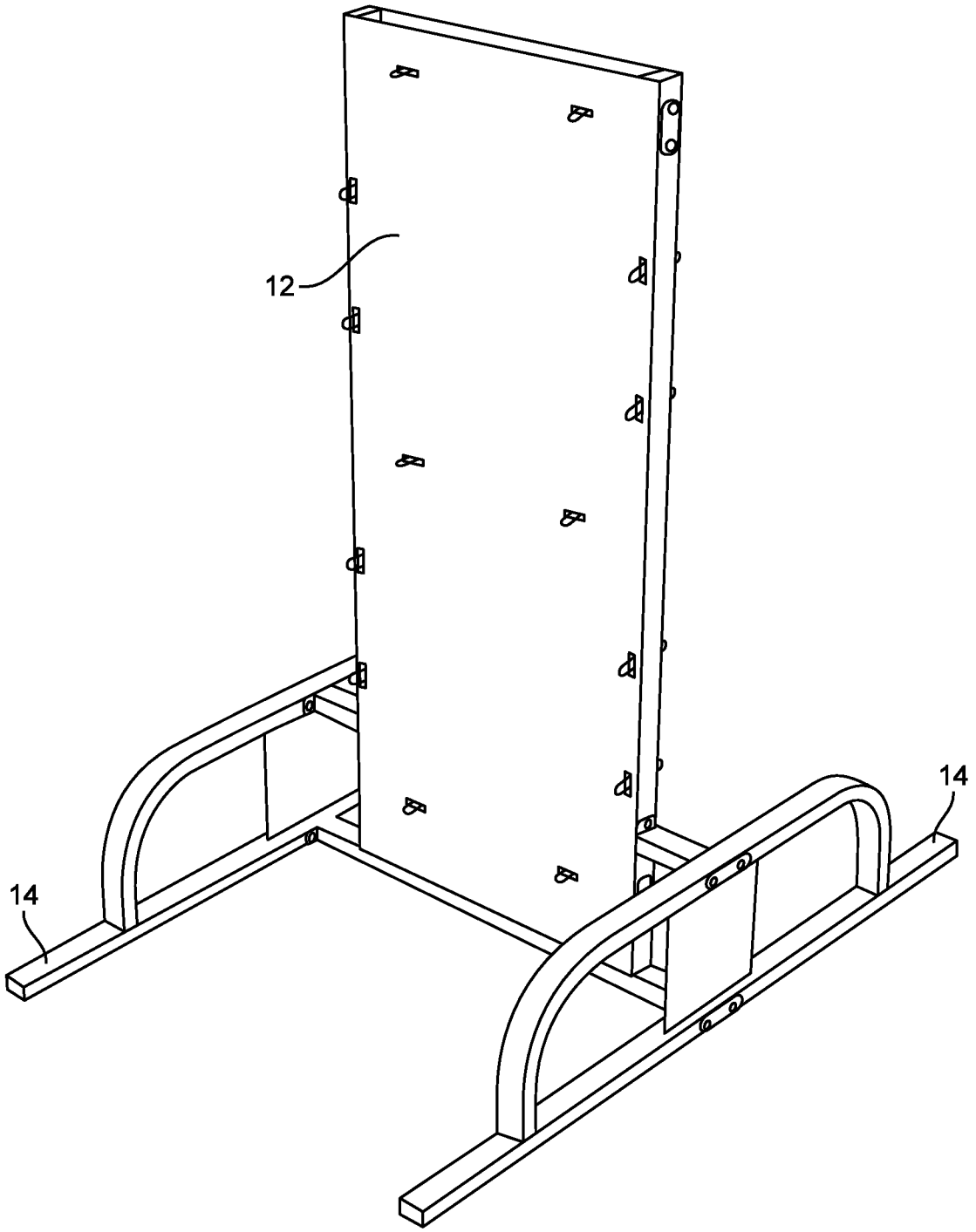
FIG. 1, according to an embodiment of the present invention, is an illustration of a perspective view of the body board device.
Figure 2:
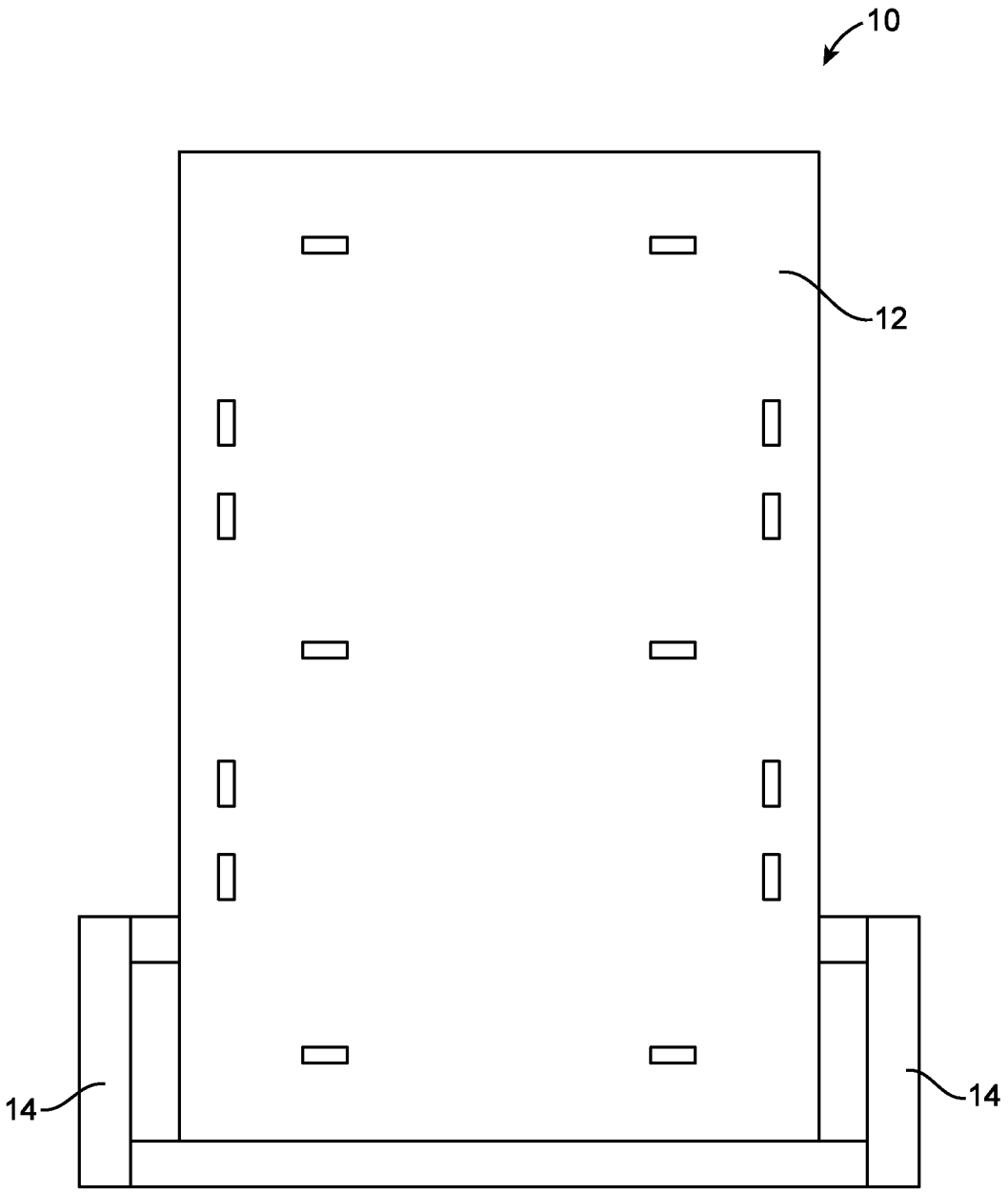
FIG. 2, according to an embodiment of the present invention, is an illustration of a front view of the body board device.
Figure 3:
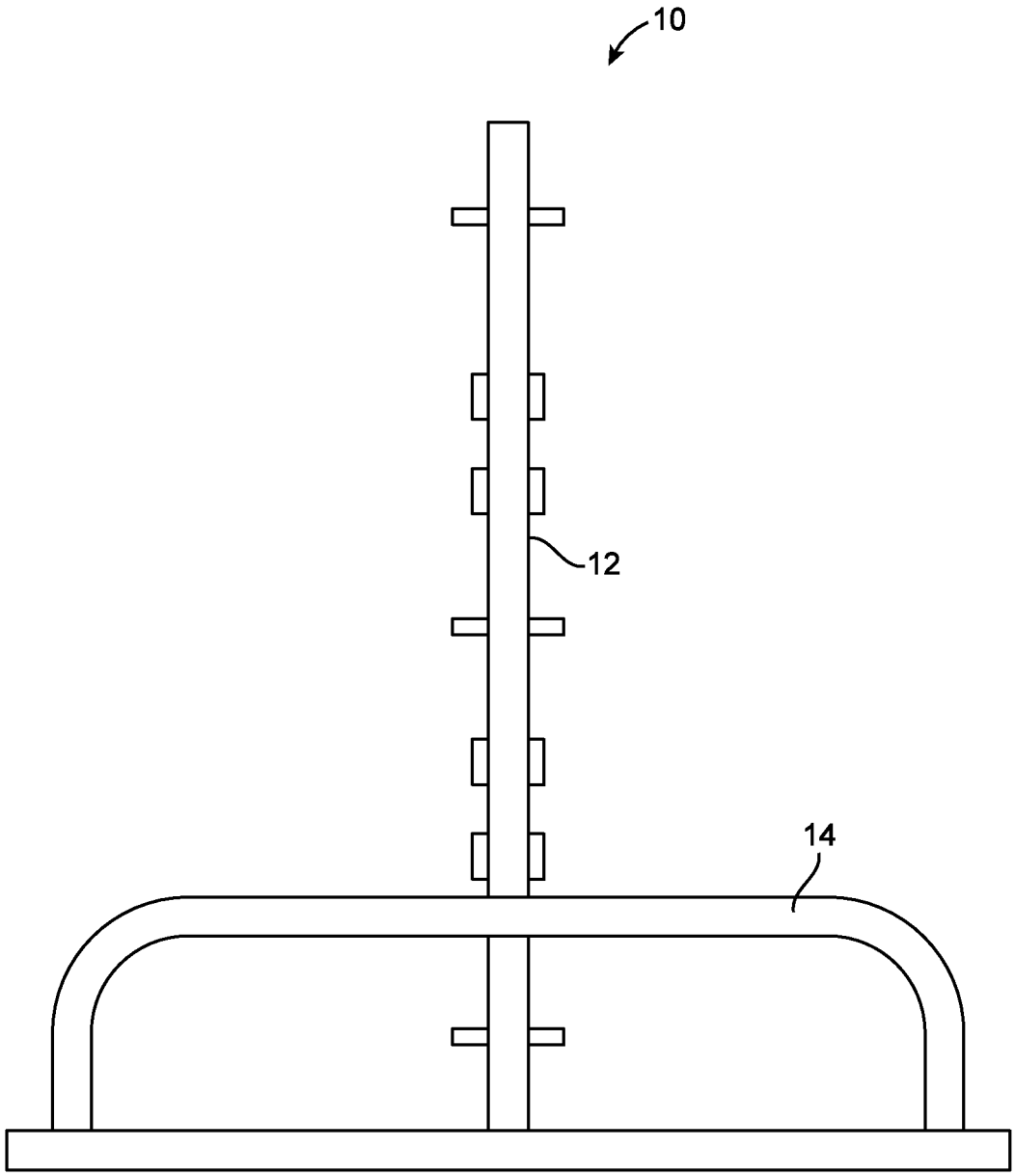
FIG. 3, according to an embodiment of the present invention, is an illustration of a side view of the body board device.
Figure 4:
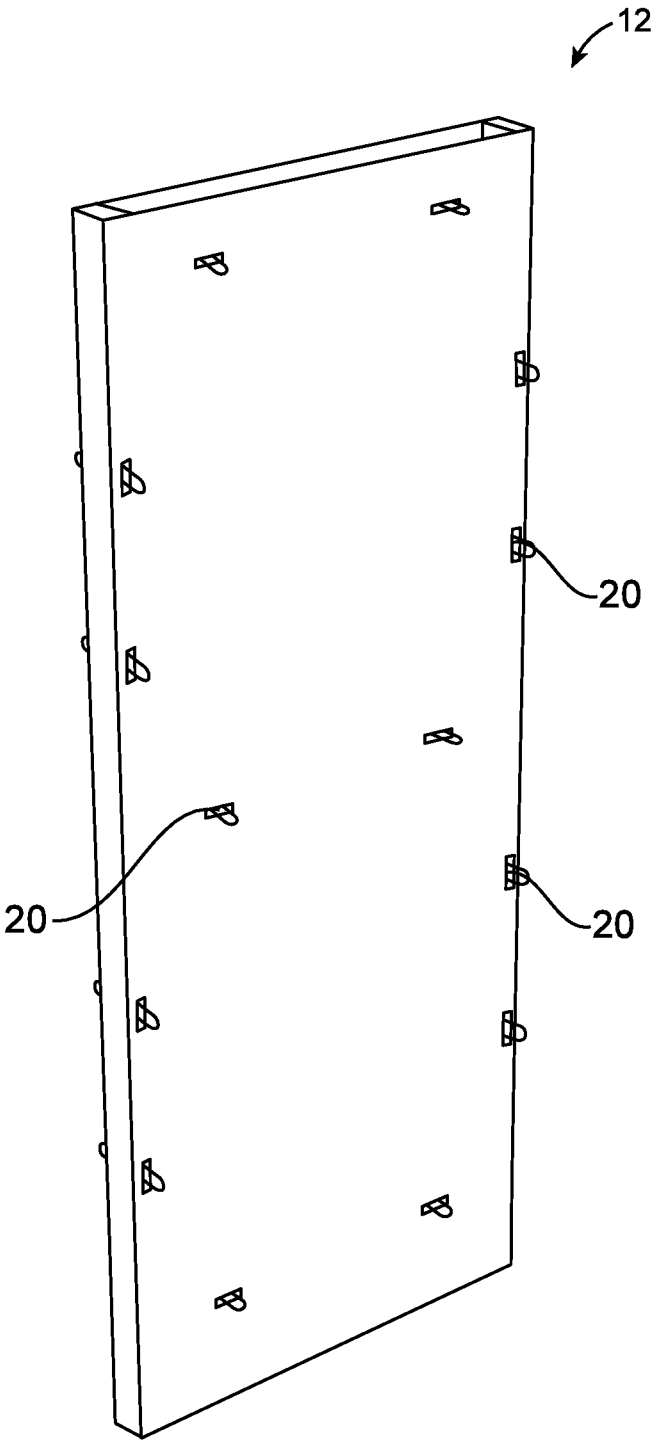
FIG. 4, according to an embodiment of the present invention, is an illustration of a perspective view of the body board.
Figure 5:
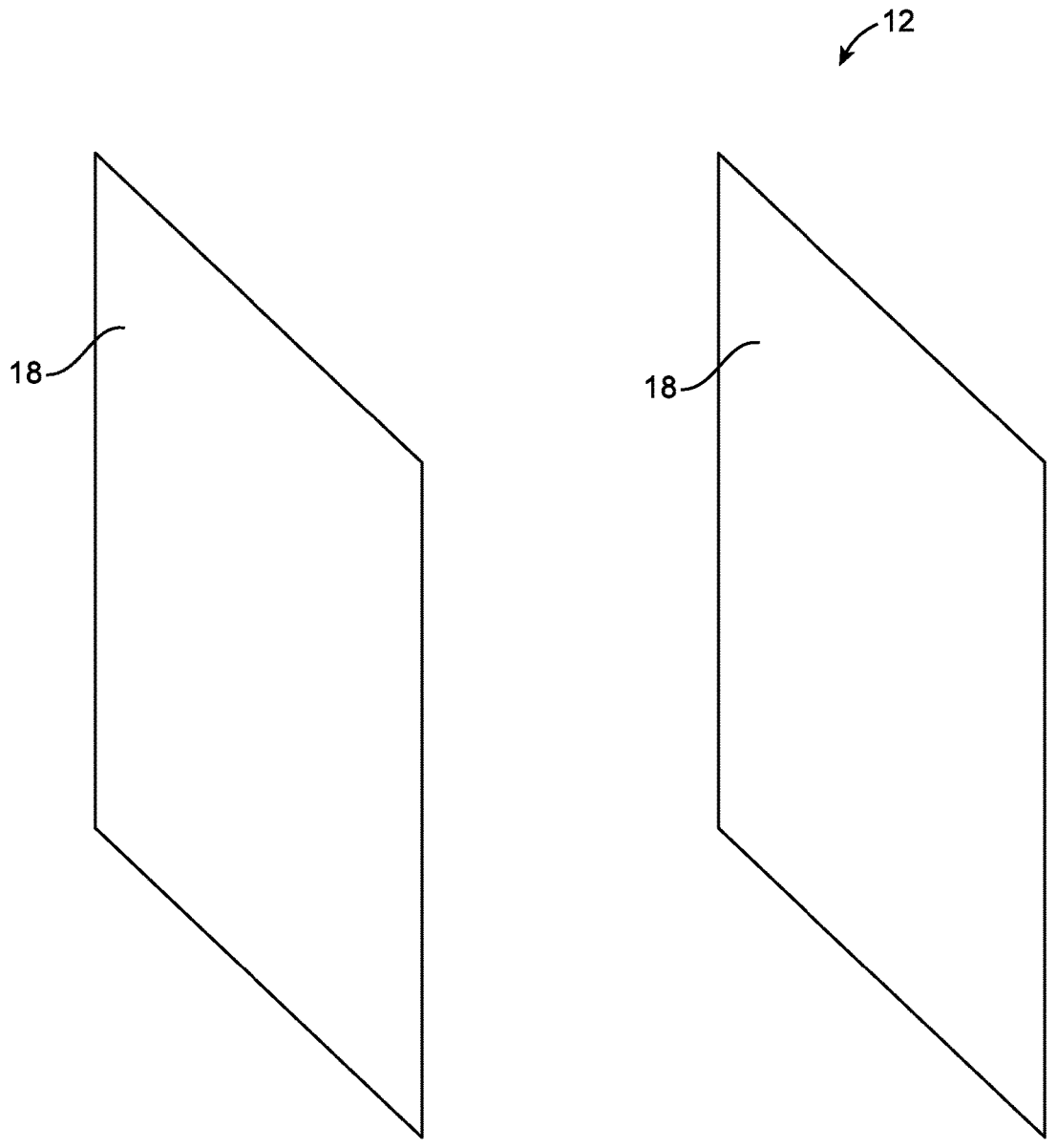
FIG. 5, according to an embodiment of the present invention, is an illustration of an exploded perspective view of the body board.
Figure 6:
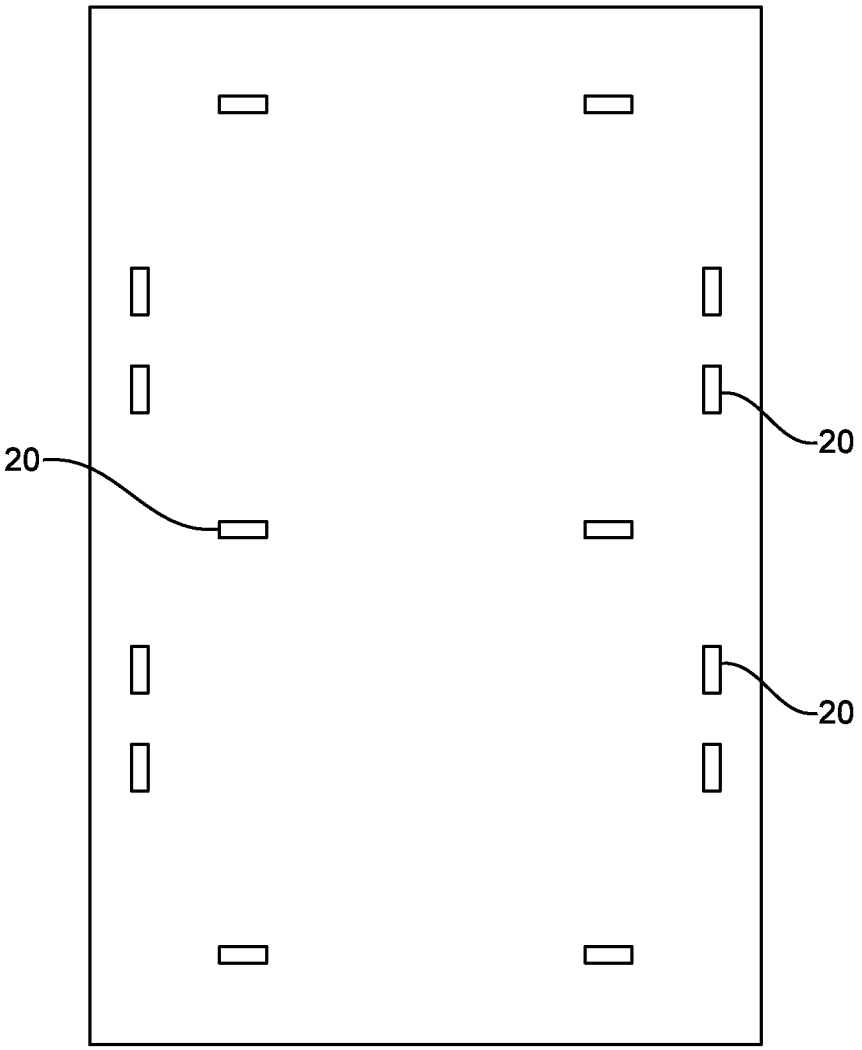
FIG. 6, according to an embodiment of the present invention, is an illustration of a front view of the body board.
Figure 7:
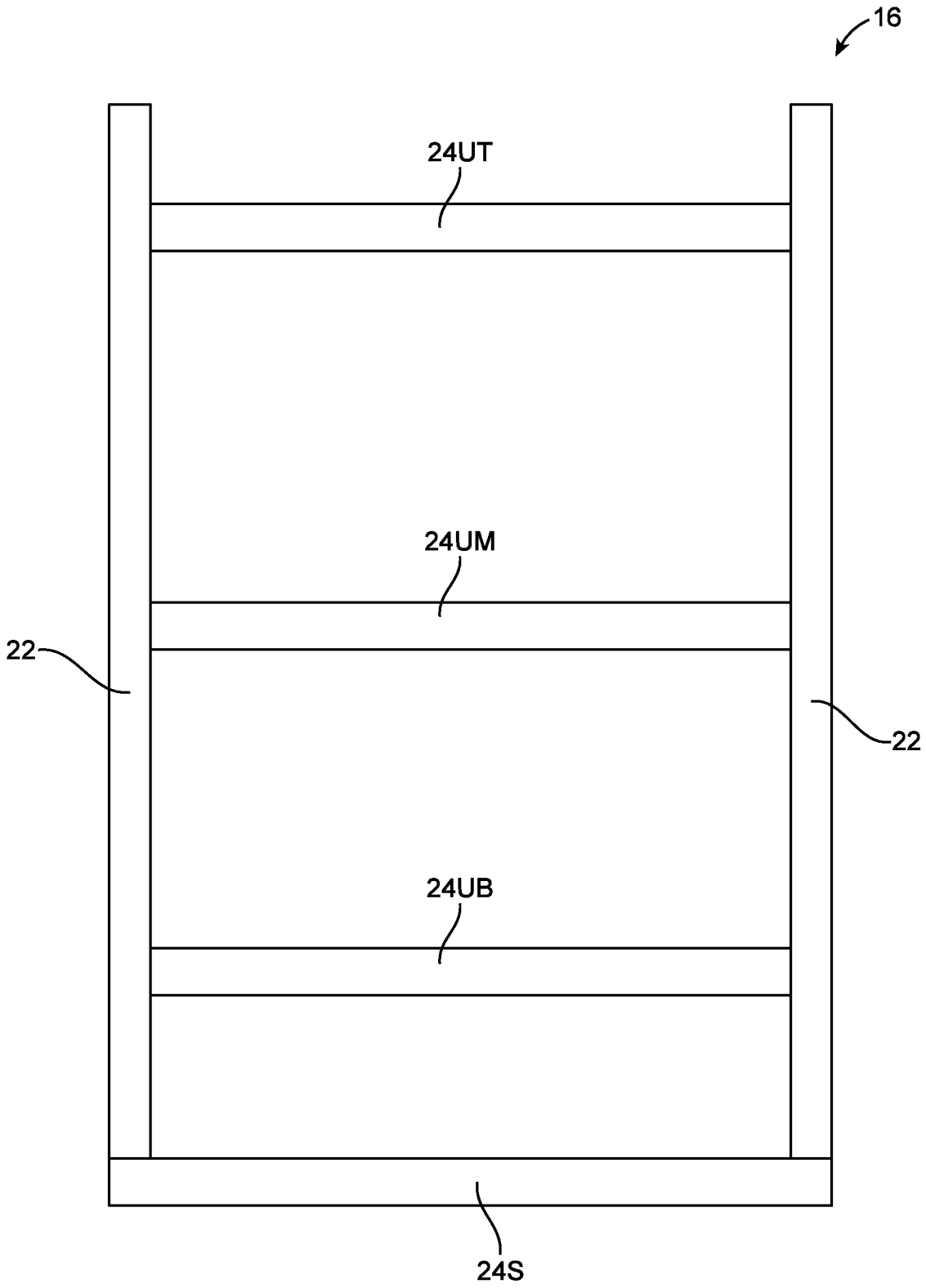
FIG. 7, according to an embodiment of the present invention, is an illustration of a front view of the frame.
Figure 8:
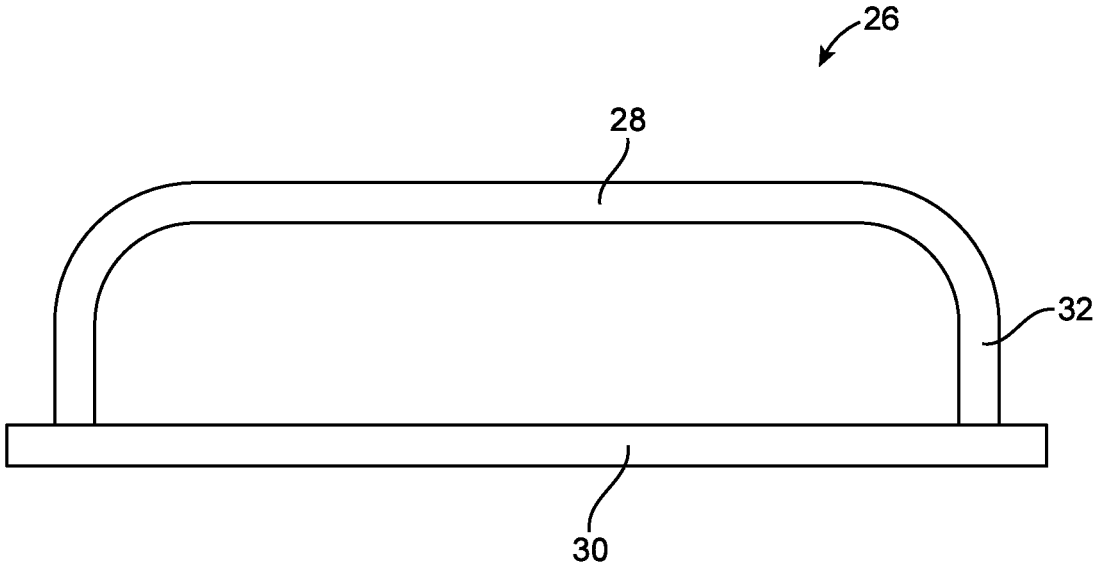
FIG. 8, according to an embodiment of the present invention, is an illustration of a front view of the leg.

Referring to FIGS. 1 through 3, the present invention comprises vertical body board fitness device 10 for enabling two users to utilize the same at the same time to perform body board exercises. The device 10, which is simple in construction, comprises a vertical body board 12 and a stand 14 to which, the body board 12 is fastened so as to support the same in the position thereof.

Referring to FIGS. 4 through 7, the body board 12 is an assemblage of a frame 16, a pair of front and rear sheets 18, and a plurality of pad eyes 20 through which fitness or resistance bands (not shown) are run. The frame 16, which is similar to a ladder, comprises a pair of vertical side board rods 22 connected by four vertically-aligned horizontal board rods 24 wherein, the vertical and the horizontal rods 22 and 24 are hollow and are of uniform rectangular cross-section. Of the four horizontal board rods 24, three horizontal board rods comprise utility board rods viz., a top utility board rod 24UT, a mid utility board rod 24UM, and a bottom utility board rod 24UB wherein, the distance between the top and the mid utility rod 24UT and 24UM, and the mid and the bottom utility rod 24UM and 24UB are equivalent. The remaining one horizontal board rod 24 comprises a support board rod 24S wherein, the support board rod 24S lies beneath the bottom utility rod 24UB and perpendicularly extends between the bottom extremities of the side board rods 22. Notably, as can be appreciated from FIGS. 6 and 7, the distance between the bottom utility 24UB and the support rod 24S is lesser than that of between the top and the mid utility rod 24UT and 24UM or the mid and the bottom utility rod 24UM and 24UB.

Referring to FIGS. 4 through 7, the front and rear sheets 18 are overlaid on the front and rear sides of the frame 16 respectively whereby, the front and rear sheets 18 act as the front and rear planar surfaces of the body board 12 respectively. A plurality of pad eyes 20 is secured to the horizontal and vertical board rods 22 and 24 through the front and rear sheets 18. More particularly, each utility board rod (24UT, 24UM and 24UB) is fitted with a pair of horizontally spaced-apart pad eyes 20 such that, the pad eyes 20 on the utility board rods (24UT, 24UM and 24UB) are horizontally and vertically aligned. Further, each portion of the side board rod 22 disposed between two consecutive utility board rods is fitted with a pair of vertically spaced-apart pad eyes 20 such that, pad eyes 20 on the side board rods 22 are vertically and horizontally aligned.

Referring to FIGS. 1 through 3, and 8, the stand 14 comprises a pair of legs 26 between which, the body board 12 is secured. Each leg 26 comprises a frame member comprising a top stand rod 28, a bottom stand rod 30, and a pair of side stand rods 32 wherein, the top, bottom and side stand rods 28, 30 and 32 are integral with one another. Notably, each stand rod (28, 30 and 32) is hollow and of uniform rectangular cross-section. The top stand rod 28 is shorter than the bottom stand rod 30 and, as the term suggests, is disposed above the bottom stand rod 30 such that, the top stand rod 28 is centrally disposed with respect to the bottom stand rod 30. Each side stand rod 32 extends from an extremity of the top stand rod 28 and joins the bottom stand rod 30. More particularly, each side stand rod 32 curves when proceeding from the top stand rod 28 and straightens when upon reaching the bottom stand rod 30 whereby, the side stand rod 32 is perpendicular to the bottom stand rod 30. The body board 12 is secured between the pair of legs 26 such that, top and bottom stand rods 28 and 30 perpendicularly abut the side board rods 22, while the horizontal board rods 24 are also disposed perpendicular to the top, side and bottom stand rods 28, 30 and 32. Notably, as can be appreciated from FIGS. 1 through 3, as the device 10 is erect, the bottom stand rods 30 and the support rod 24S abut the ground.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Figure 9:
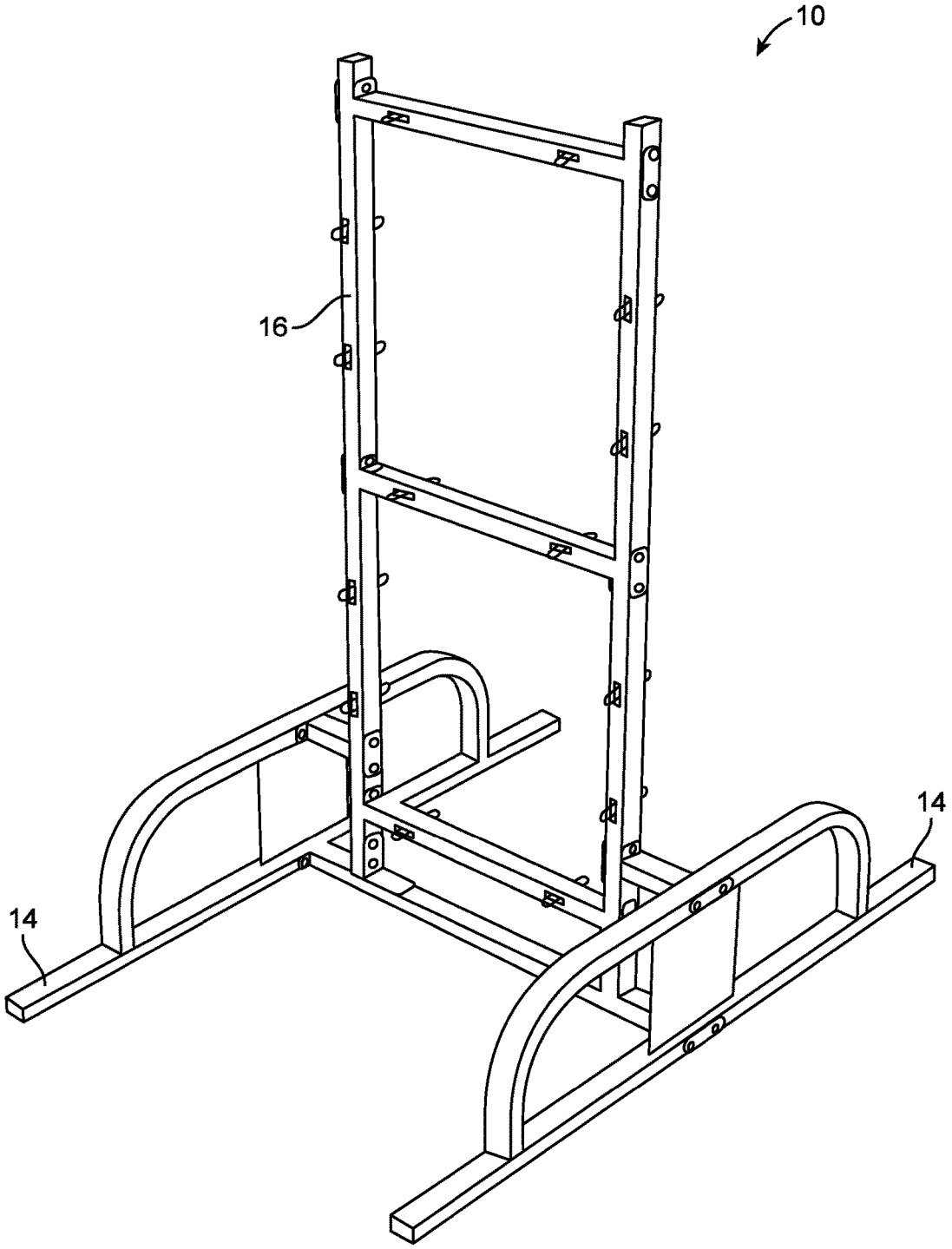
FIG. 9, according to an alternate embodiment of the present invention, is an illustration of a perspective view of the body board device.

Although the embodiments herein are described with various specific embodiments, it will be obvious for a person skilled in the art to practice the invention with modifications. For instance, as can be appreciated from FIG. 9, in one embodiment, the frame 16 is employed in lieu of the body board 12. However, all such modifications are deemed to be within the scope of the claims.

I claim:

1. A body board fitness device comprising:

a body board having a first side and a second side, said body board comprising a rectangular frame comprising:

(i) a pair of opposingly-disposed vertical side board rods; and (ii) a plurality of horizontal board rods comprising:

(a) three utility rods comprising: (i) a top utility rod; (ii) a mid utility rod; and (iii) a bottom utility rod; and (b) a support rod lying beneath said utility rods; wherein, the distance between said top and said mid utility rod, and said mid and said bottom utility rod being equivalent, whereas, the distance between said bottom utility and said support rod being lesser than that of between said top and said mid utility rod or said mid and said bottom utility rod; said plurality of horizontal board rods connecting said side board rods such that, said horizontal board rods are perpendicular to said side board rods; and wherein, each board rod is of uniform rectangular cross-section;

a pair of opposingly-disposed sheets attached over the front and rear of said frame;

resistance bands;

a plurality of pad eyes extending from said body board and disposed on either side thereof, said pad eyes for running said resistance bands therethrough;

a stand, wherein said body board is secured to said stand; and wherein, a pair of horizontally spaced-apart pad eyes extend from each sheet where said sheet comes into contact with each utility rod, and wherein, a pair of vertically spaced-apart pad eyes extends from the portions of each side board rod that lie between said top and said mid utility rods and between said mid and said bottom utility rods; said pad eyes extending from said sheet; and wherein said first side and said second side of said body board are identical and capable of simultaneous use by two different users.

2. The device of claim 1 wherein, said body board is rectangular.

3. The device of claim 2 wherein, said stand comprises a pair of legs between which said body board is secured, each leg comprising: (a) a horizontal bottom stand rod that abuts the ground; (b) a horizontal stand top rod, which is shorter than said bottom stand rod and is disposed above and centrally with respect to said bottom stand rod; and (c) a pair of side stand rods, each of which for connecting said top and bottom stand rods; wherein, said body board is disposed between said pair of legs such that, said horizontal stand rods and said horizontal board rods are perpendicular to one another.

4. The device of claim 3 wherein, each stand rod is of uniform rectangular cross-section.

5. The device of claim 4 wherein, each side stand rod curves when proceeding from an extremity of said top stand rod and straightens when upon reaching said bottom stand rod; said side stand rod being perpendicular to said bottom stand rod.

6. The device of claim 5 wherein, each leg comprises a unitary piece.

* * * * *